US008555489B2

(12) United States Patent
Malstrom

(10) Patent No.: US 8,555,489 B2
(45) Date of Patent: Oct. 15, 2013

(54) CRIMP ASSEMBLY FOR A TERMINAL CRIMPING MACHINE

(75) Inventor: Charles Randall Malstrom, Lebanon, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 1269 days.

(21) Appl. No.: 12/392,733

(22) Filed: Feb. 25, 2009

(65) Prior Publication Data

US 2010/0212147 A1 Aug. 26, 2010

(51) Int. Cl.
*H01R 43/058* (2006.01)

(52) U.S. Cl.
USPC ..... 29/753

(58) Field of Classification Search
USPC ..... 29/753, 751, 761
See application file for complete search history.

(56) References Cited

U.S. PATENT DOCUMENTS 2,144,231 A * 1/1939 Schwarz ..... 72/396

* cited by examiner

*Primary Examiner* — Livius R Cazan

(57) ABSTRACT

A crimp assembly for a terminal crimping machine that crimps a terminal to a wire includes a crimper frame having opposed ends and a longitudinal axis extending between the opposed ends. The crimper frame has a jaw mount chamber therein being open at one of the ends of the crimper frame. The crimper tame has abutment surfaces defining portions of the jaw mount chamber. Crimp tooling is held within the jaw mount chamber. The crimp tooling has terminal engagement surfaces configured to engage the terminal to form a wire crimp during a crimping process. The crimp tooling has outer surfaces, wherein the abutment surfaces of the crimper frame engage the outer surfaces of the crimp tooling during the crimp process to move the crimp tooling in a first direction generally along the longitudinal axis and in a second direction transverse to the first direction. Optionally, the crimp tooling may constitute split-jaw crimp fooling having a pair of crimper jaws movable with respect to one another.

17 Claims, 7 Drawing Sheets

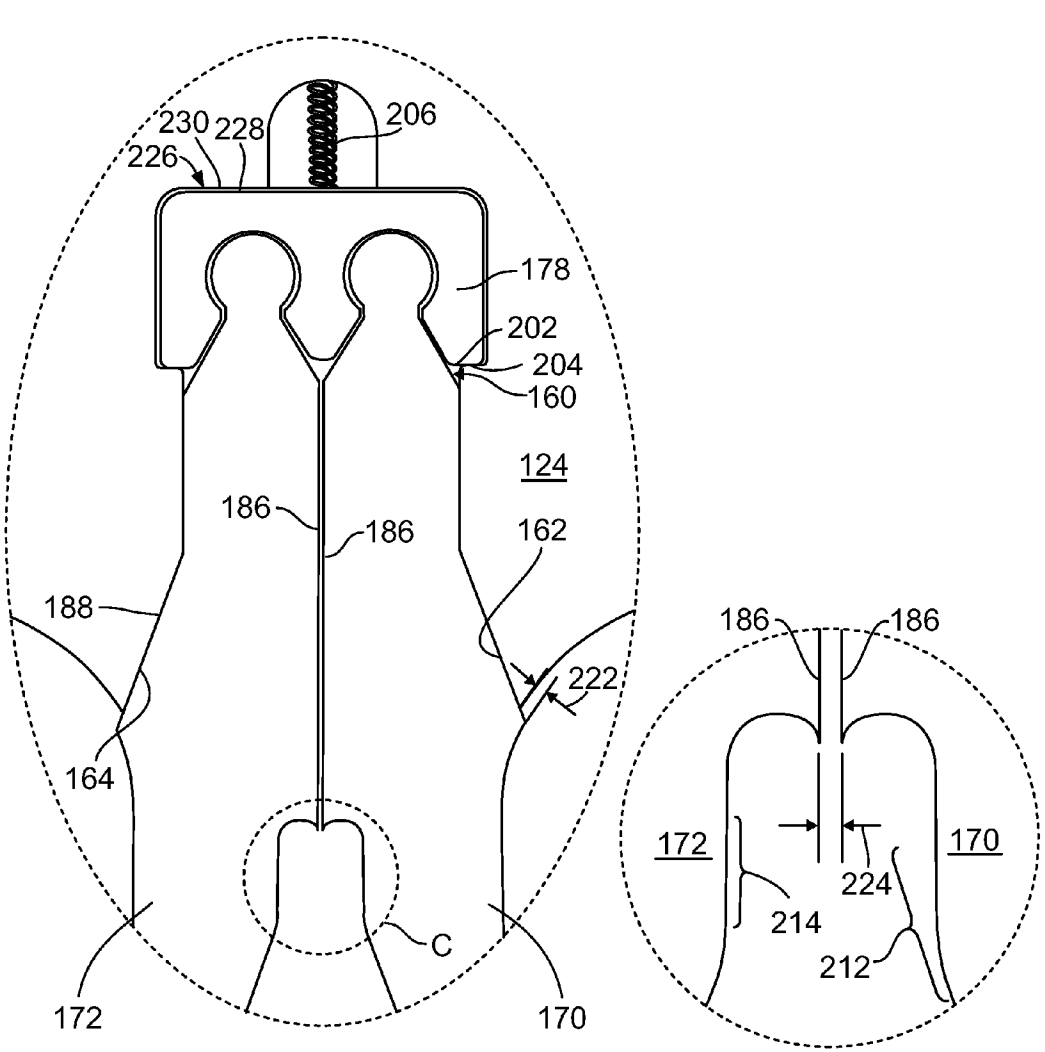
FIG. 4B
FIG. 4C
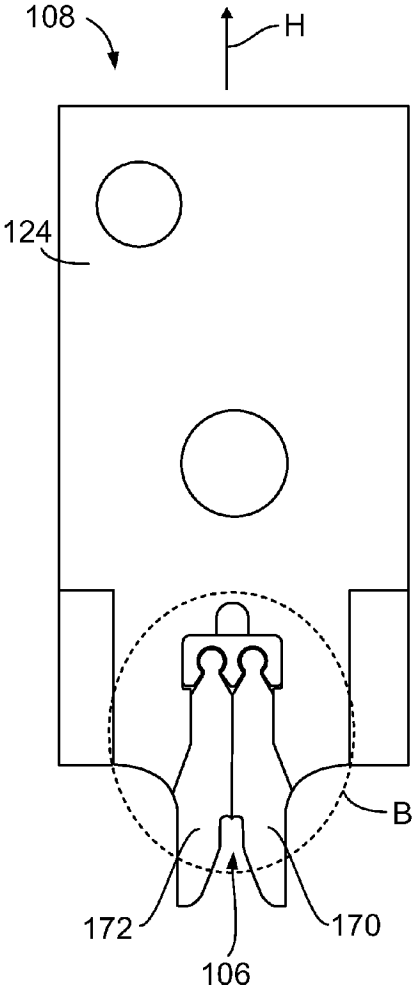
FIG. 4A

CRIMP ASSEMBLY FOR A TERMINAL CRIMPING MACHINE

BACKGROUND OF THE INVENTION

The subject matter herein relates generally to terminal crimping machines for crimping electrical terminals to conductors of a wire, and, more particularly, to crimp assemblies for terminal crimping machines.

Terminal crimping machines have long been used in the connector industry to effect high-speed mass termination of various cables. It is common practice for the terminal crimping machine to have an interchangeable tooling assembly called an applicator, and a powered mechanism called a terminator. In general, such terminal crimping machines are referred to as a terminator or press, however other types of terminal crimping machines may similarly be used, such as a lead maker, a bench machine, or a hand crimping tool. The terminal crimping machines include crimp tooling and an anvil that are moved relatively closer to one another during a crimping stroke to crimp a terminal or connector to an end of a wire. Typically, the anvil is stationary and the crimp tooling is driven toward and away from the anvil during a crimp stroke.

However, these known terminal crimping machines are not without disadvantages. For instance, during crimping a phenomenon known as flashing may occur when the terminal is not precisely aligned with the anvil. Flashing results in a portion of the terminal leaking past the supporting surface of the anvil and creeping down the side of the anvil. Typically, due to manufacturing tolerances, the anvil is narrower than the crimp tooling to allow clearance between the sides of the anvil and the crimp tooling. During the crimping process, the base of the terminal rests upon the anvil and is flattened out and forced into base corners. When enough force is applied, and the clearances are large enough relative to the terminal stock thickness, flash will start to occur. As flash is starting to form, the crimp tooling can and sometimes will shift to one side or the other with respect to the anvil. This shift maximizes the clearance to one side allowing more flash to occur. Flashing degrades the integrity of the crimp and may lead to crimp edge shear, which significant weakens the crimp. Flashing and crimp shear are exaggerated when crimping relatively small terminals to wires because the tolerances are larger relative to the overall size of the terminal and stock thickness of the terminal.

Typically, terminal crimping machines have crimp tooling with inner walls that have a radiused lead-in to the forming portion of the inner walls. The inner walls are angled away from one another at a crimp angle typically between approximately 3° and 6°. The crimp angle and radiused lead-in allow the terminal to be released alter crimping due to the outward taper of the terminal and the crimp tooling below the terminal. However, the radiused lead-in and crimp angle define the amount of clearance between the crimp tooling and the anvil. A proposed solution to the flashing problem is to reduce the clearance between the anvil and the crimp tooling. To do this, the lead-in radius and the crimp angle are reduced. However, additional problems arise when reducing the lead-in radius and the crimp angle. For instance, the terminal tends not to release from the crimp tooling when the lead-in radius and the crimp angle are too small, which may lead to shutdown of the terminal crimping machine to remove the terminal by hand. The crimp tooling and/or the anvil may be damaged if the terminal is not fully removed prior to the next crimp.

An additional problem associated with conventional terminal crimping machines is the phenomenon known as terminal spring back. During the crimping process, the terminal is formed around the wire by pressing the terminal inward toward the wire. The crimp tooling and anvil form a terminal base and side walls or wings that extend from base corners. The wings are folded over toward the wire. After the tooling is released, the stresses of the terminal tend to force the wings to spring back and rotate outward away from one another reducing the grip or normal force between the terminal and the wire and/or between the wings themselves. The spring back degrades the quality of the crimp.

A need remains for a crimp assembly for a terminal crimping machine that is capable of forming quality crimps. A need remains for a crimp assembly that reduces flashing and allows the terminal to release from the crimp tooling. A need remains for a crimp assembly that reduces problems associated with outward spring back of the wings of the terminal after the terminal is formed.

BRIEF DESCRIPTION OF THE INVENTION

In one embodiment, a crimp assembly is provided for a terminal crimping machine that crimps a terminal to a wire. The crimp assembly includes a crimper frame having opposed ends and a longitudinal axis extending between the opposed ends. The crimper frame has a jaw mount chamber therein being open at one of the ends of the crimper frame. The crimper frame has abutment surfaces defining portions of the jaw mount chamber. Crimp tooling is held within the jaw mount chamber. The crimp tooling has terminal engagement surfaces configured to engage the terminal to form a wire crimp during a crimping process. The crimp tooling has outer surfaces, wherein the abutment surfaces of the crimper frame engage the outer surfaces of the crimp tooling during the crimp process to move the crimp tooling in a first direction generally along the longitudinal axis and in a second direction transverse to the first direction. Optionally, the crimp tooling may constitute split-jaw crimp tooling having a pair of crimper jaws movable with respect to one another. Optionally, the crimp assembly may include a support member having opposed crimper deflection stops. The crimper frame may be held by the support member and include opposed side walls that face corresponding crimper deflection stops. The crimper frame may be movable along a deflection axis extending between the crimper deflection stops. The crimper jaws may be splayed apart by the terminal during the crimping process such that the outer surfaces bear against the abutment surfaces and force the crimper frame to deflect outward toward the crimper deflection stops.

The crimper jaws may be mirrored halves of the crimp tooling. The crimper jaws may be coplanar with the crimper frame and with one another. Optionally, the crimp assembly may include a jaw mount held by the crimper frame having sockets holding corresponding crimper jaws, where the crimper jaws being movable with respect to the jaw mount. The jaw mount may hold an end of each crimper jaw such that the crimper jaws are pivotally coupled to the jaw mount. The crimper jaws may be configured to release away from one another after the wire crimp is formed to release the terminal from the terminal engagement surfaces. The crimper jaws may be translated longitudinally at least partially out of the jaw mount chamber during a return stroke portion of the crimping process to allow relative movement of the crimper jaws away from one another. Each of the crimper jaws may include mating surfaces that are forced into engagement with one another during the crimping process.

In another embodiment, a terminal crimping machine that crimps a terminal to a wire is provided that includes a crimper frame having a jaw mount chamber open at an end of the crimper frame and abutment surfaces defining portions of the jaw mount chamber. Split-jaw crimp tooling having two crimper jaws separate from one another are held within the jaw mount chamber. Each crimper jaw has terminal engagement surfaces configured to engage the terminal to form a wire crimp during a crimping process. The crimper jaws are movable with respect to one another during the crimping process.

In a further embodiment, a crimp assembly for a terminal crimping machine that crimps a terminal to a wire is provided that includes a support member having opposed crimper deflection stops and a crimper frame held by the support member. The crimper frame has opposed side walls that face corresponding crimper deflection stops, and the crimper frame is movable along a deflection axis extending between the crimper deflection stops. The crimper frame has a jaw mount chamber and abutment surfaces defining portions of the jaw mount chamber. The crimp assembly also includes split-jaw crimp tooling having two crimper jaws separate from one another and held within the jaw mount chamber. Each crimper jaw has terminal engagement surfaces configured to engage the terminal to form a wire crimp during a crimping process. Each crimper jaw has an outer surface engaged by a corresponding abutment surface during the crimping process. The crimper jaws are splayed apart by the terminal during the crimping process such that the outer surfaces bear against the abutment surfaces and force the crimper frame to deflect outward toward the crimper deflection stops.

BRIEF DESCRIPTION OF THE DRAWINGS

FIG. 4A is a front view of a portion of the crimp assembly shown in FIG. 2A in a released position.

FIG. 4B is a close-up view of a portion of the crimp assembly shown in FIG. 4*a*.

FIG. 4C is a close-up view of a portion of the crimp assembly shown in FIG. 4*b*.

DETAILED DESCRIPTION OF THE INVENTION

Figure 1:
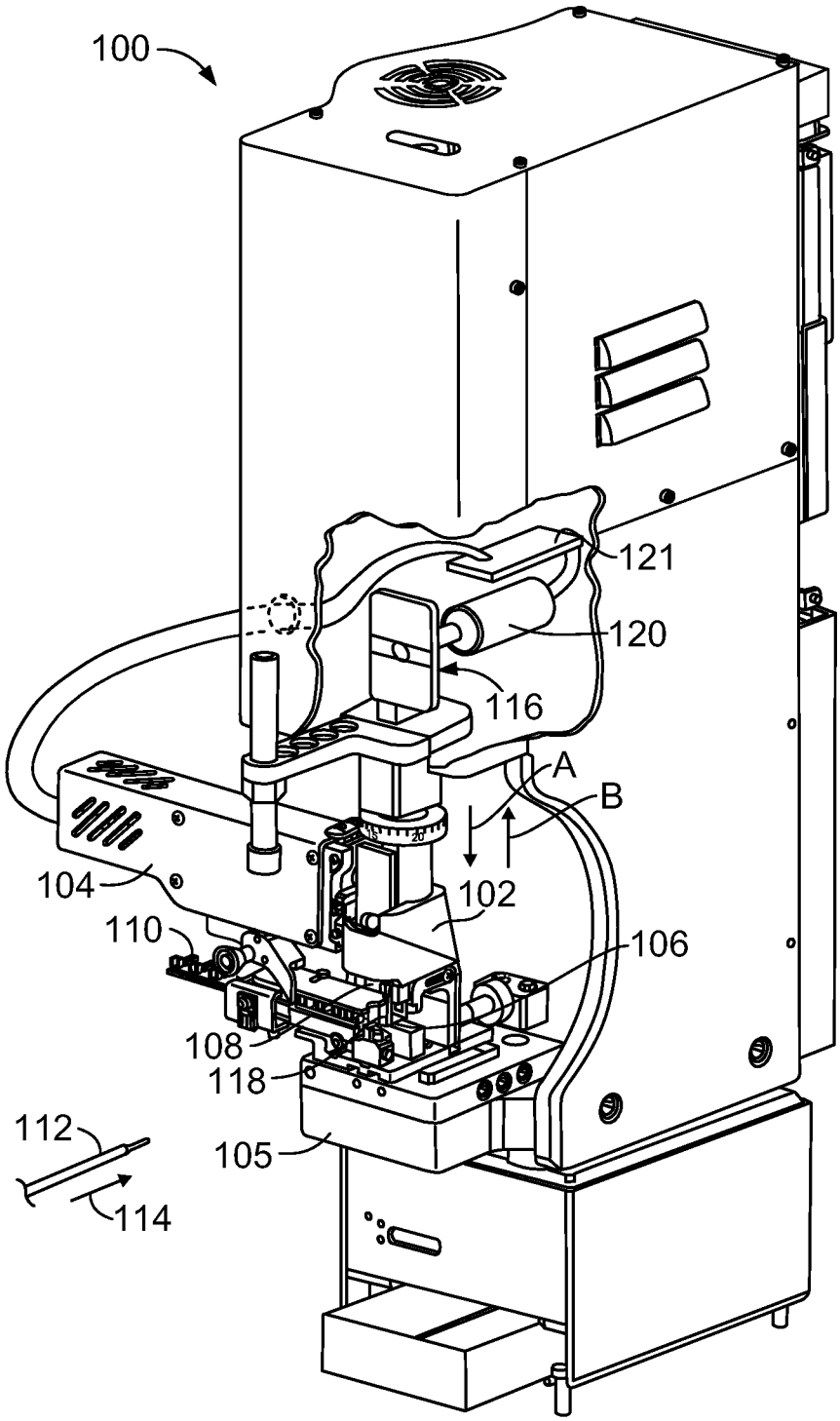
FIG. 1 is a perspective view of a termination machine having a crimp assembly formed in accordance with an exemplary embodiment.

FIG. 1 is a perspective view of a terminal crimping machine 100 having a termination tool 102 with a crimp assembly 108 and a feeder 104. The terminal crimping machine 100 is used for crimping connectors or terminals to wires, however, other types of terminal crimping machines 100 may be used. In the illustrated embodiment, the terminal crimping machine 100 is a terminator or press, however other types of terminal crimping machines may similarly be used, such as a lead maker, a bench machine, a hand crimping tool and the like. Furthermore, while the termination tool 102 is illustrated and described hereinafter with respect to an applicator 102, other types of termination tools 102 may be used depending on the type of terminal crimping machine. In the illustrated embodiment, the feeder 104 is an electrically actuated feeder 104, however other types of feeders 104, such as pneumatic feeders, cam and linkage feeders, and the like, may be used depending on the type of terminal crimping machine.

The applicator 102 is coupled to a frame 105 of the terminal crimping machine 100. The applicator 102 has a terminating zone or crimping zone 106 in the case of the terminal crimping machine 100. The crimp assembly 108 is coupled to the applicator 102 for crimping electrical connectors or terminals 110 to an end of a wire 112 in the crimping zone 106. The applicator 102 may be removed and replaced with a different applicator, such as when a different size/type of terminal 110 is to be terminated, when a different size/type of wire 112 is to be terminated, when the applicator 102 is worn or damaged, or when an applicator having a different configuration is desired. As such, multiple applicators 102 may be used with each terminal crimping machine 100, and the different applicators 102 may have different set-up configurations.

The feeder 104 is positioned to feed terminals 110 accurately to the applicator 102 and presents the terminals 110 to the crimping zone 106. Optionally, the feeder 104 may be positioned adjacent to, or even coupled to, the applicator 102. Alternatively, the feeder 104 may be positioned remote with respect to the applicator 102, but still delivers the terminals 110 to the crimping zone 106. The terminals 110 may be guided to the crimp zone 106 by a guide member (not shown) of the feeder 104 to ensure proper positioning of the terminals 110 within the crimping zone 106. The wires 112 are delivered to the crimping zone 106 by a wire feeder, wire transfer, swivel mechanism, or the like (not shown) for the lead maker or terminator, or an operator for a bench machine or hand crimping tool. The wires 112 are delivered in a wire loading direction 114. The feeder 104 may be configured to deliver, and the applicator 102 may be configured to receive, multiple steed terminals 110 for crimping. The feeder 104 may be configured to deliver either side-feed terminals or end-feed terminals. Side-feed terminals are arranged side-by-side on a carrier strip and end-feed terminals are arranged successively, end-to-end.

During operation, the crimp assembly 108 is driven through a crimp stroke by a driving mechanism 116 of the terminal crimping machine 100 toward a stationary anvil 118. The driving mechanism 116 may be a ram or other mechanical component cyclically driven through the crimp stroke. The crimp stroke has both an advancing or downward component, shown by the arrow A, and a return or upward component, shown by the arrow B. The crimp assembly 108 is advanced downward toward the anvil 118 to a seated position, in which the terminal 110 is crimped to the wire 112 to form the wire crimp. The crimp assembly 108 is returned upward to a released position. In which the crimp assembly 108 is positioned away from the anvil 118. The crimping of the terminal 110 to the wire 112 occurs during the downward component of the crimp stroke. The driving mechanism 116 is driven by a terminator actuator 120. Optionally, the terminator actuator 120 may be a motor having a crank shaft that moves the driving mechanism 116. Alternatively, the terminator actuator 120 may be a linear actuator, a piezoelectric actuator, a pneumatic actuator, and the like. The operation of the terminator actuator 120 is controlled by a control module 121.

Figure 2A:
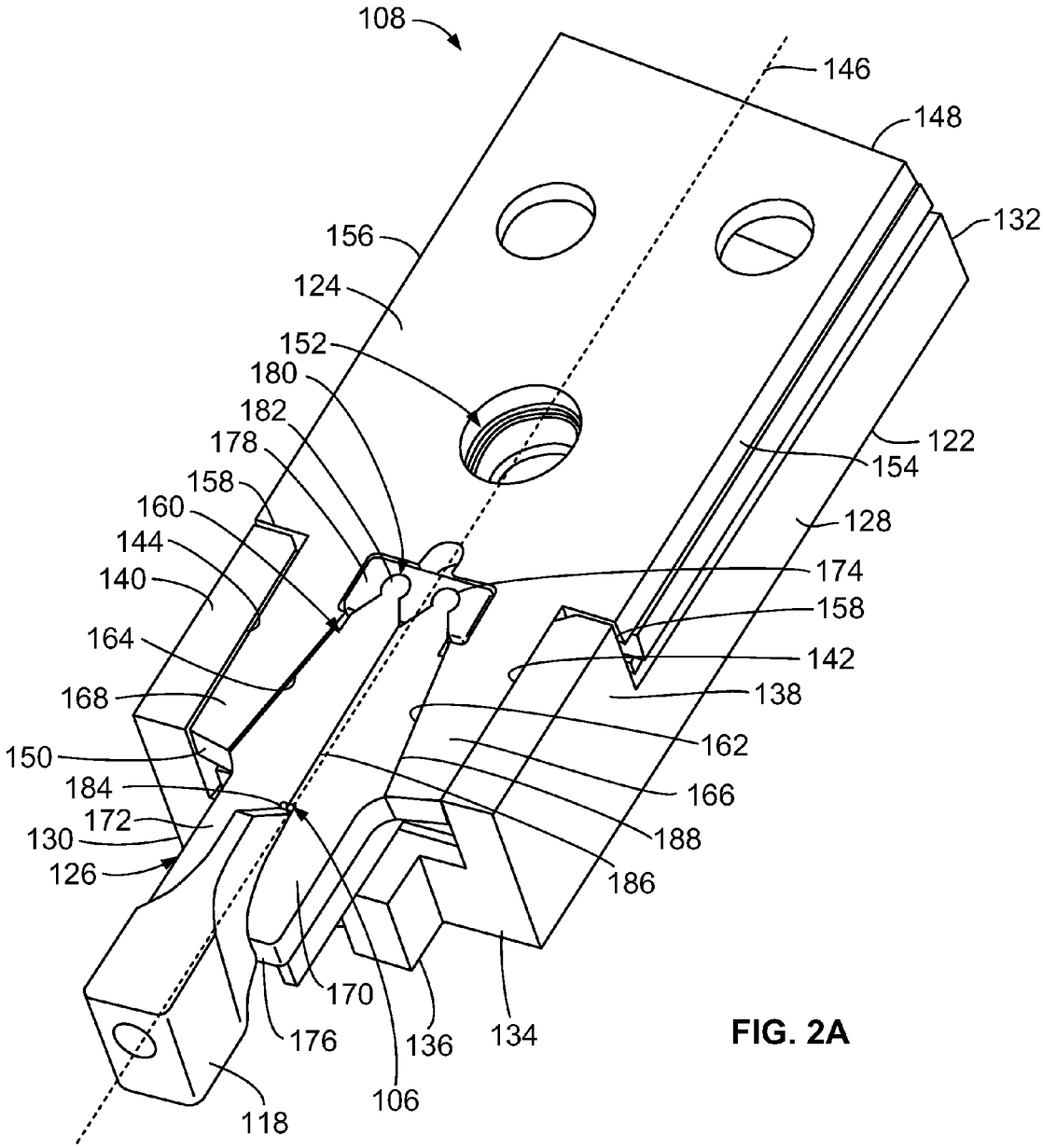
FIG. 2A is a perspective view of the crimp assembly shown in FIG. 1.
Figure 2B:
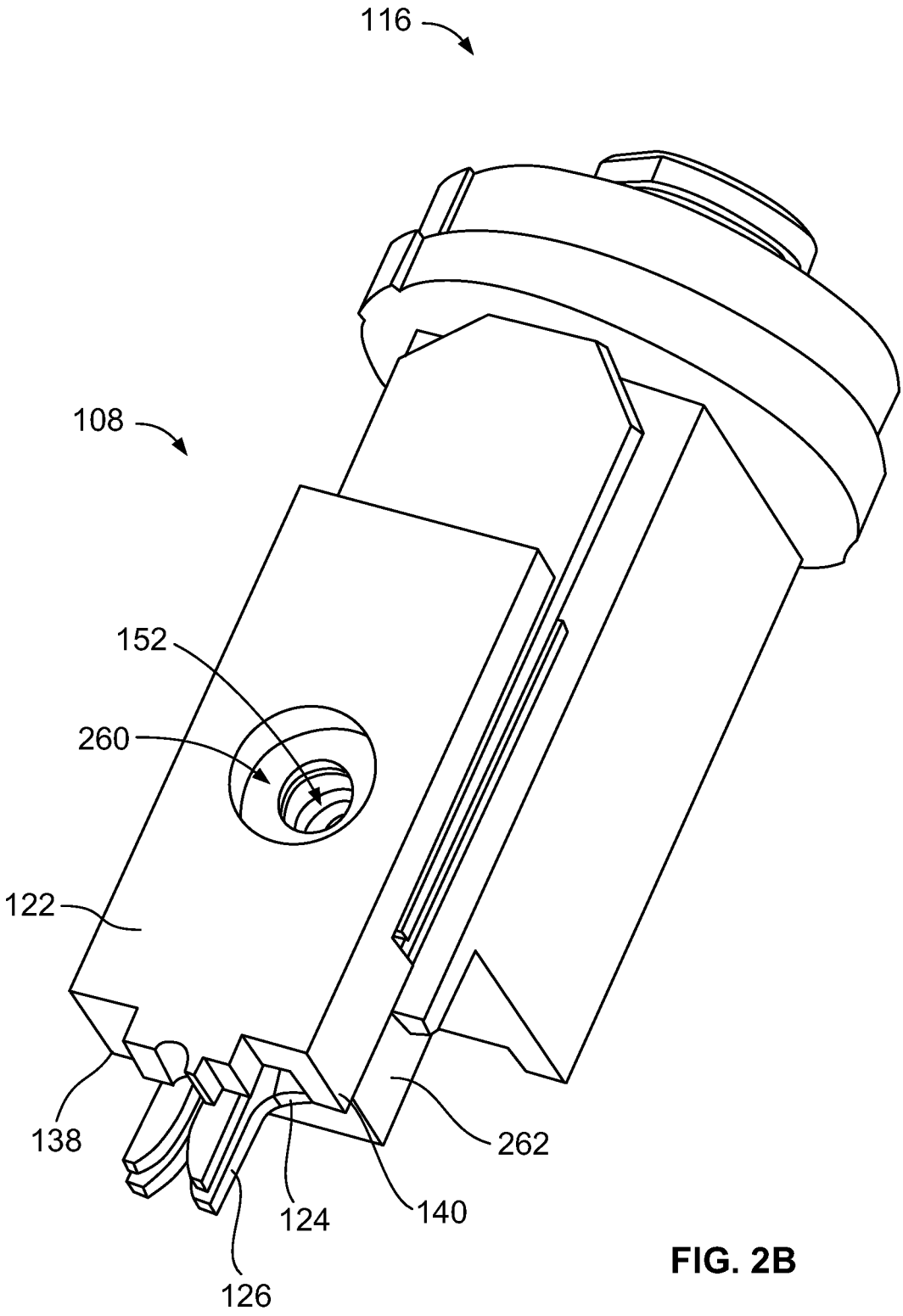
FIG. 2B illustrates a driving mechanism having the crimp assembly mounted thereto.

FIG. 2A is a front perspective view of the crimp assembly 108 positioned with respect of the anvil 118. FIG. 2B is a rear perspective view of the crimp assembly 108 positioned with respect of the anvil 118, showing the crimp assembly 108 mounted to the driving mechanism 116. The crimp assembly 108 includes a support member 122 that holds a crimper frame 124. The crimper frame 124 may be held additionally, or alternatively, by another structure, such as the driving mechanism 116 (shown in FIG. 1). The crimp assembly 108 also includes crimp tooling 126 held by the crimper frame 124. The crimp tooling 126 cooperates with the anvil 118 to crimp the terminal 110 (shown in FIG. 1) to the wire 112 (shown in FIG. 1) in the crimping zone 106.

The support member 122 includes opposed sides 128, 130 that extend between a top 132 and a bottom 134. Optionally, the support member 122 may include a shear depressor 136 that extends from the bottom 134 and is located proximate to the crimping zone 106. The shear depressor 136 is configured to shear the terminal 110 from a carrier strip (not shown) that holds the terminal 110 and is used to present the terminal 110 at the crimping zone 106. The shear depressor 136 shears the terminal 110 from the carrier strip during the crimping process, such as along a downward component of the crimp stroke.

The support member 122 includes crimper deflection stops 138, 140. The crimper deflection stops 138, 140 are located along the sides 128, 130, respectively proximate to the bottom 134. The crimper deflection stops 138, 140 lie outside of the crimper frame 124 and include inwardly facing engagement surfaces 142, 144 that face the crimper frame 124. The crimper frame 124 may engage the engagement services 142, 144 during the crimping process. Optionally, the crimper deflection stops 138, 140 define deflection limits for the crimper frame 124 to limit the outward movement of the crimper frame 124 during the crimping process. The crimper deflection slops 138, 140 may have a different size or shape other than the box shape illustrated in FIG. 2A. The crimper deflection stops 138, 140 may be positioned in different locations with respect to the support member 122 and/or crimper frame 124 in alternative embodiments. More or less than two crimper deflection stops may be provided in other embodiments. In an alternative embodiment, no deflection stops may be provided.

The support member 122 may be separately provided from the driving mechanism 116 or ram, and may be coupled to the driving mechanism 116. Alternatively, the support member 122 may be integrally formed with the driving mechanism 116. The support member 122 may be separate from the driving mechanism 116 and may be coupled to another structure.

The crimper frame 124 includes a generally planar body extending along a longitudinal axis 146 between a top end 148 and a bottom end 150 opposed from one another. The longitudinal axis 146 generally extends in a direction that is parallel to the direction of movement of the crimp assembly 108 during the crimping process. The crimper frame 124 is held by the support member 122. In an exemplary embodiment, a fastener (not shown) secures the crimper frame 124 to the support member 122. For example, the fastener may extend through an opening 152 through the crimper frame 124. The fastener may be a pin, a threaded fastener, or another type fastened.

The crimper frame 124 extends between opposed sides 154, 156. The sides 154, 156 are notched out at the bottom end 150 such that the bottom end 150 is narrower and the top end 148 is wider. The narrower bottom end 150 is aligned with and fits between the crimper deflection stops 138, 140. The notched out areas may define shoulders 158 that rest upon the crimper deflection stops 138, 140.

The crimper frame 124 includes a jaw mount chamber 160 therein that is open at the bottom end 150 of the crimper frame 124. The jaw mount chamber 160 is defined at least in part by inwardly facing abutment surfaces 162, 164. In an exemplary embodiment, the abutment surfaces 162, 164 are angled such that the surfaces are nonparallel to the longitudinal axis 146. The abutment surfaces 162, 164 are angled inward from the bottom end 150 such that the abutment surfaces 162, 164 are spaced further apart proximate to the bottom end 150. As such, the jaw mount chamber 160 is wider proximate to the bottom end 150 and becomes narrower along the abutment surfaces 162, 164. The jaw mount chamber 160 receives the crimp tooling 126 therein and the abutment surfaces 162, 164 are configured to engage the crimped tooling 126. Beams 166, 168 of the crimper frame 124 are defined between the abutment surfaces 162, 164 and the sides 154, 156, respectively, within the notched out area of the sides 154, 156.

In an exemplary embodiment, the crimp fooling 126 constitutes split jaw crimp tooling having a pair of crimper jaws 170, 172 movable with respect to one another. Optionally, the crimper jaws 170, 172 may be mirrored halves of the crimp tooling 126 having substantially similar features. The crimper jaws 170, 172 extend along opposite sides of the anvil 118 and the terminal 110 crimped by the crimp tooling 126 and anvil 118. The crimper jaws 170, 172 are generally coplanar with the crimper frame 124.

Each crimper jaw 170, 172 extends between a top 174 and a bottom 176. In an exemplary embodiment, the top 174 is secured within the jaw mount chamber 160 and the bottom 176 is freely movable with respect to the crimper frame 124, as will be described in further detail below. In an exemplary embodiment, the crimp assembly 108 includes a jaw mount 178 that holds the crimper jaws 170, 172 within the jaw mount chamber 160. The jaw mount 178 includes sockets 180 that hold the tops 174 of the crimper jaws 170, 172. In an exemplary embodiment, the tops 174 include balls 182 that are received in the sockets 180 of the crimper jaws 170, 172 and that are movable with respect to the jaw mount 178. For example, the crimper jaws 170, 172 may be pivotally coupled to the jaw mount 178 such that the balls 182 may be pivoted within the sockets 180.

The crimper jaws 170, 172 have terminal engagement surfaces 184 configured to engage the terminal 110 to form the wire crimp during the crimping process. The crimper jaws 170, 172 each have an inner surface 186 that face one another and/or engage one another during the crimping process. The inner surfaces 186 generally extend along the longitudinal axis 146. The crimper jaws 170, 172 each have an outer surface 188 that faces a corresponding abutment surface 162, 164 of the crimper frame 124. In an exemplary embodiment, the outer surfaces 188 are angled nonparallel to longitudinal axis 146. The outer surfaces 188 may be angled outward such that the outer surfaces 188 are closer to the inner surfaces 186 proximate to the top thereof and the outer surfaces 188 are further from the inner surfaces 186 proximate to the bottom thereof.

During the crimping process, the abutment surfaces 162, 164 engage the outer surfaces 188 to drive the crimp tooling 126 along the crimp stroke. In an exemplary embodiment, the crimper frame 124 engages the outer surfaces 188 to move the crimper jaws 170, 172 in a first direction generally along the longitudinal axis 146 and a second direction that is transverse to the first direction. For example, the crimper jaws 170, 172 are forced generally toward one another in a direction that represents the second direction when the abutment surfaces 162, 164 engage the outer surfaces 188. The angled nature of the outer surfaces 188 create a wedge effect on the crimper jaws 170, 172 by the crimper frame 124. For example, the linear forces in the direction of longitudinal axis 146 are transferred to me crimper jaws 170, 172 to force the crimp tooling 126 in the direction of longitudinal axis 146. A portion of the linear force is transferred by the angled outer surfaces 188 in a direction that is transverse to the longitudinal axis 146. For example, the force may be perpendicular to the angled outer surfaces 188.

FIG. 2B illustrates the driving mechanism 116, represented by a ram of an applicator, having the crimp assembly 108 mounted thereto. The crimp assembly 108 is secured to the driving mechanism 116 by a fastener (not shown) that extends through the opening 152 through the crimper frame 124 and a corresponding opening 260 through the support member 122. The fastener may be a pin, a threaded fastener, or another type fastener. The support member 122 includes the crimper deflection stops 138, 140.

A cover 262 extends along the crimper frame 124 and holds the crimper frame 124 within the support member 122. In an alternative embodiment, the cover 262 may define a support member that includes crimper deflection stops in addition to, or in lieu of, the crimper frame 124. The cover 262 may be securely coupled to the driving mechanism 116. The crimper frame 124 and crimp tooling 126 may be movable with respect to the cover 262.

Figures 3A, 3B, 3C:
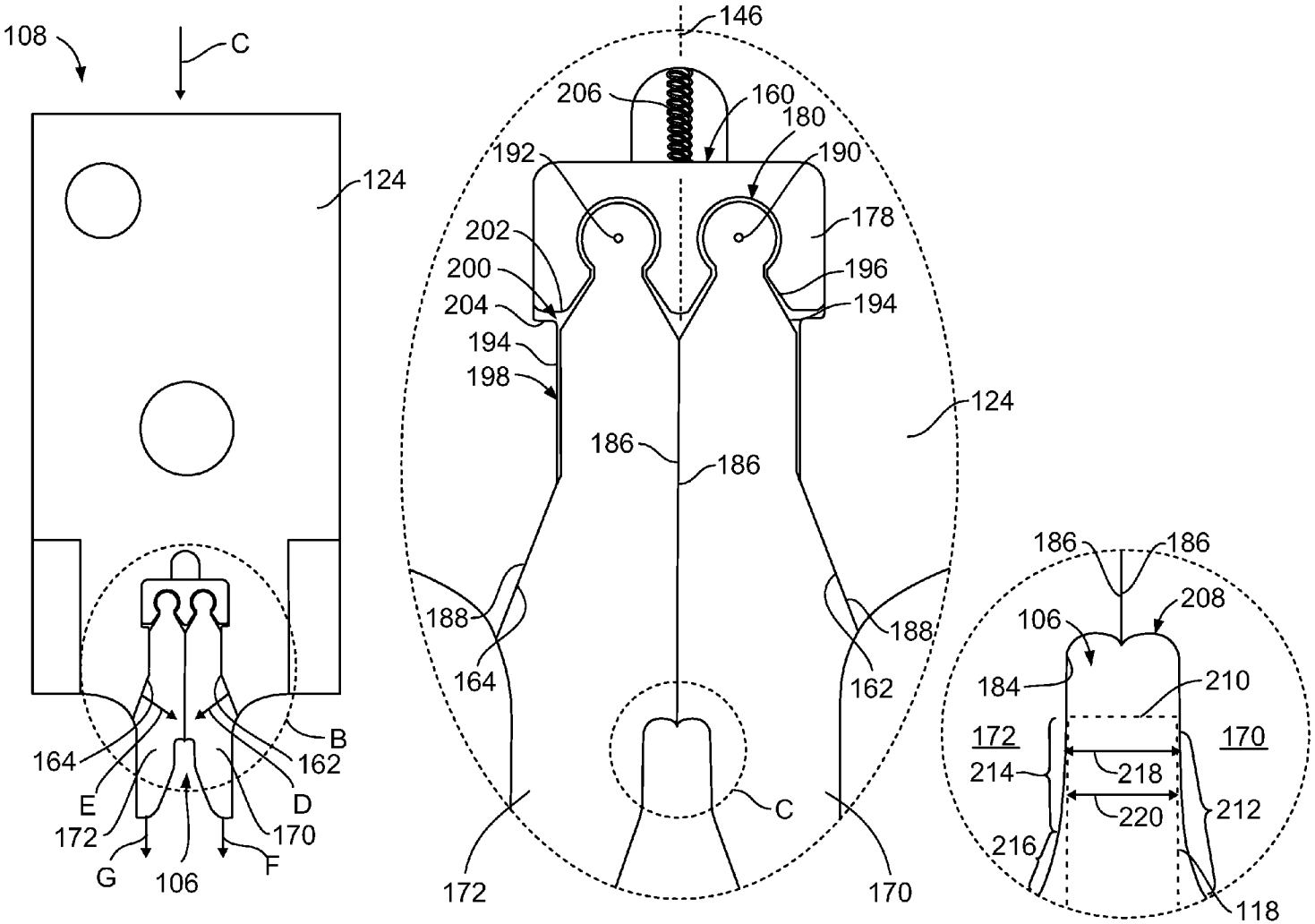
FIG. 3A is a front view of a portion of the crimp assembly shown in FIG. 2A in a seated position.
FIG. 3B is a close-up view of a portion of the crimp assembly shown in FIG. 3*a*.
FIG. 3C is a close-up view of a portion of the crimp assembly shown in FIG. 3*b*.
Figure 5A:
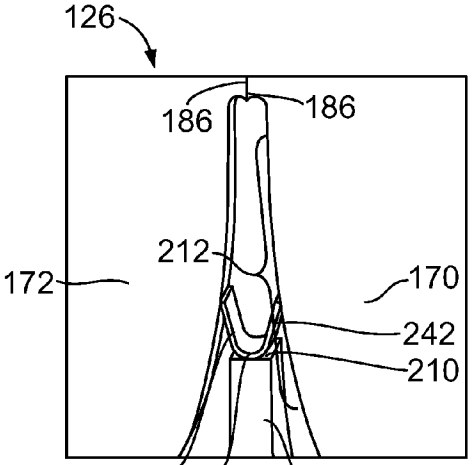
FIG. 5 illustrates a series of steps of a crimping process using the crimp assembly shown in FIG. 2A in accordance with an exemplary embodiment.
Figure 5B:
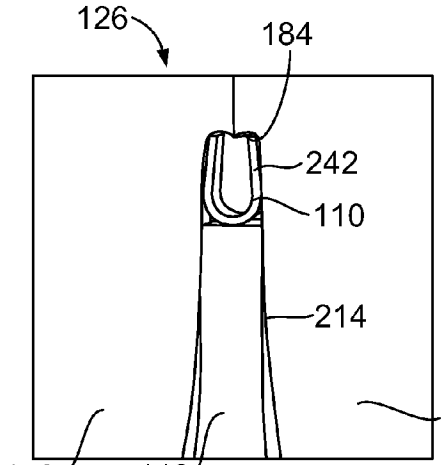
Figure 5C:
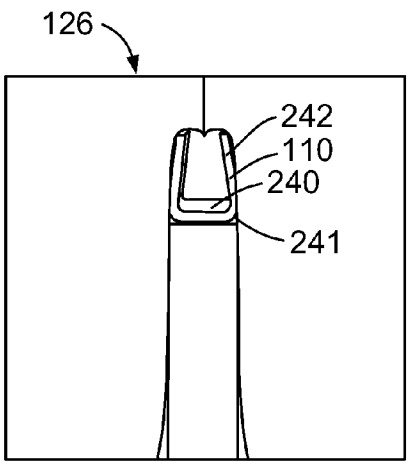
Figure 5D:
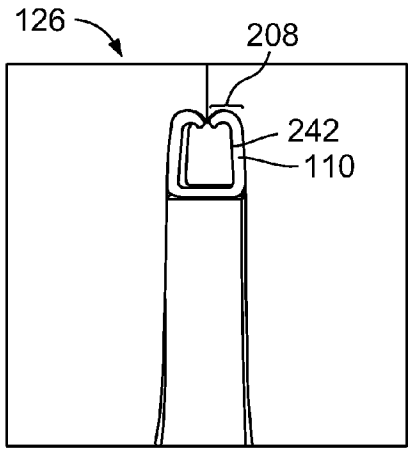
Figure 5E:
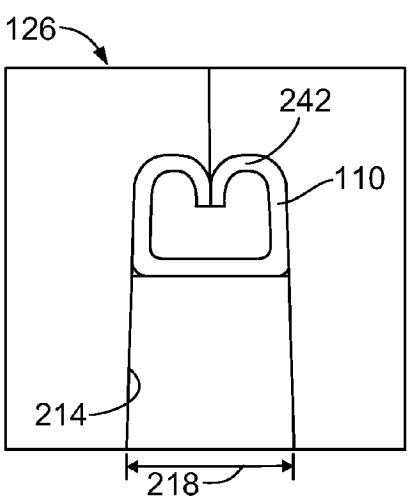
Figure 5F:
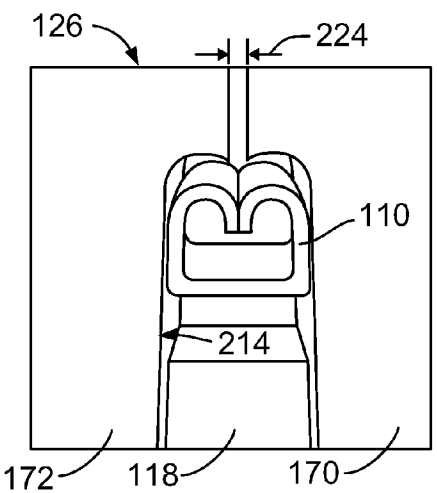
Figure 6A:
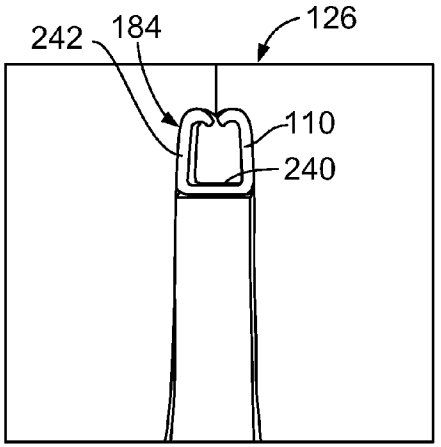
FIG. 6 illustrates a series of steps of the crimping process using the crimp assembly shown in FIG. 2A with the crimp tooling of the crimp assembly deflecting during the crimping process.
Figure 6B:
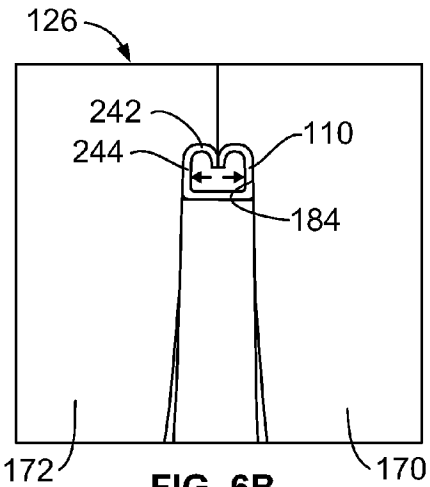
Figure 6C:
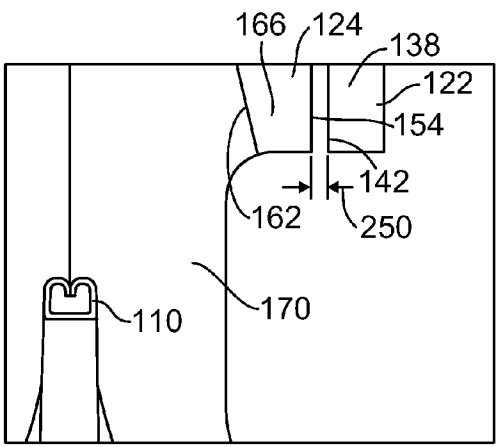
Figure 6D:
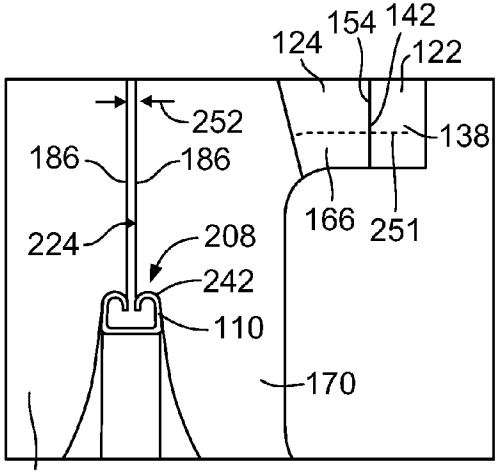
Figure 6E:
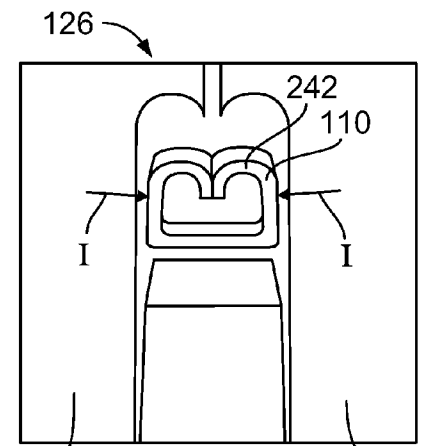

FIG. 3A is a front view of a portion of the crimp assembly 108 in a seated position. FIG. 3B is a close-up view of a portion of the crimp assembly 108 shown in FIG. 3A. FIG. 3C is a close-up view of a portion of the crimp assembly 108 shown in FIG. 3B. The crimp assembly 108 is advanced downward to the seated position by the driving mechanism 116 (shown in FIG. 1), such as in the direction of the arrow C, generally in the direction of the terminal 110 (shown in FIG. 1) situated in the crimping zone 106. The crimp assembly 108 forms the terminal 110 as the crimp assembly 108 is advanced to the seated position, and the wire crimp is completely formed when the crimp assembly 108 is in the seated position. The crimp assembly 108 does not advance any further downward from the seated position. Rather, the crimp assembly 108 is retracted upward to the released position, which is shown in FIGS. 4A-4G, from the seated position.

During operation, as the crimper frame 124 is advanced downward, the abutment surfaces 162, 164 engage the outer surfaces 188 of the crimper jaws 170, 172 to drive the crimper jaws 170, 172 generally inward toward one another and downward toward the anvil 118. FIG. 3A illustrates the multiple movement directions of the crimper jaws 170, 172 as the crimp assembly 108 is transferred to the seated position. For example, the crimper jaws 170, 172 are moved inward toward one another by the crimper frame 124, which is represented by arrows D and E, respectively. The crimper jaws 170, 172 are moved downward with the crimper frame 124, which is represented by arrows F and G, respectively.

FIG. 3B illustrates the abutment surfaces 162, 164 in abutting contact with the outer surfaces 188 of the crimper jaws 170, 172. The crimper frame 124 generally forces the crimper jaws 170, 172 toward one another until the inner surfaces 186 engage one another. The crimper jaws 170, 172 may be pivoted about pivot axes 190, 192 of the sockets 180 of the jaw mount 178. In the seated position, clearance is provided between sidewalls 194 of the crimper jaws 170, 172 and corresponding sidewalls 196 of the sockets 180. The clearance allows the crimper jaws 170, 172 to move with respect to the jaw mount 178, such as to rotate or pivot within the sockets 180.

A gap 198 is defined between the sidewalls 194 and the crimper frame 124 when the crimp assembly 108 is in the seated position. The gap 198 allows the crimper jaws 170, 172 to move outward away from one another and toward the crimper frame 124, such as to the position illustrated in FIG. 4B. The crimper jaws 170, 172 are able to move outward toward the crimper frame 124 when the abutment surfaces 162, 164 do not engage the outer surfaces 188 of the crimper jaws 170, 172, as will be described in further detail below.

In the seated position, a space 200 is defined between a bottom 202 of the jaw mount 178 and a shoulder 204 of the crimper frame 124. The space 200 allows the jaw mount 178 to move downward with respect to the crimper frame 124 and/or for the crimper frame 124 to move outward with respect to the jaw mount 178. Because the crimper jaws 170, 172 are fixed vertically with respect to the jaw mount 178, the crimper jaws 170, 172 are movable vertically along the longitudinal axis 146 within the jaw mount chamber 160. The jaw mount 178 resists torque by an interference between the sides of the jaw mount 178 and the crimper frame 124. As such, the crimper jaws 170, 172 are positioned at the same vertical height with respect to one another at all times. When the crimp assembly 108 is moved to the released position, the crimper frame 124 is pulled upward and the jaw mount 178 and crimper jaws 170, 172 may be moved downward relative to the crimper frame 124. Optionally, a biasing element 206, such as a spring, may be attached between the crimper frame 124 and the jaw mount 178 to force the bottom 202 of the jaw mount 178 towards and/or into engagement with the shoulders 204 of the crimper frame 124, such as to the position illustrated in FIG. 40.

FIG. 3C illustrates the terminal engagement surfaces 184 at the crimping zone 106 with the anvil 118 shown in phantom. In the seated position, the inner surfaces 186 of the crimper jaws 170, 172 engage one another. The terminal engagement surfaces 184 have fold-over sections 208 configured to fold wings of the terminal 110 inward towards the wire 112 (shown in FIG. 1) and towards each other. The anvil 118 includes a support surface 210 that holds the terminal 110 during the crimping process.

The crimper jaws 170, 172 include lead-in sections 212 that extend from the terminal engagement surfaces 184. The lead-in sections 212 are defined below the support surface 210. The lead-in sections 212 guide the terminal 110 and/or the anvil 118 into position relative to the terminal engagement surfaces 184 for the crimp. The lead-in sections 212 have a vertical segment 214 that extends substantially vertically along the longitudinal axis 146. The vertical segments 214 may be angled outward at an angle of less than 3°. Optionally, the vertical segments 214 may not be angled outward at all, but rather are completely parallel to one another. The lead-in sections 212 have a flared segment 216 that is flared outward. The transition between the vertical segment 214 in the flared segment 216 may be curved. The vertical segments 214 are spaced apart by a distance 218 that is substantially equal to, and/or slightly wider than a width 220 of the anvil 118. A slight gap may be formed between the anvil 118 and the lead-in sections 212. The size of the gap may be controlled to lit within tight tolerances and may be selected to reduce and/or eliminate flashing of the terminal 110 during the crimping process. Because of the tight tolerance, it may be difficult for the terminal 110 to be released from the crimper jaws 170, 172 when the inner surfaces 186 engage one another. However, the spilt design of the crimp tooling 126 allows the crimper jaws 170, 172 to separate from one another to provide room between the lead-in sections 212 and the terminal 110 so that the terminal 110 can be released from the crimp tooling 126.

FIG. 4A is a front view of a portion of the crimp assembly 108 in a released position. FIG. 48 is a close-up view of a portion of the crimp assembly 108 shown in FIG. 4A. FIG. 4C is a close-up view of a portion of the crimp assembly 108 shown in FIG. 48. The crimp assembly 108 is retracted upward to the released position by the driving mechanism 116 (shown in FIG. 1), such as in the direction of the arrow H, generally away from the crimping zone 106. The crimp assembly 108 releases the terminal 110 as the crimp assembly 108 is retracted to the released position. From the released position, the crimp assembly 108 is again advanced downward to the seated position as part of the crimping process.

During operation, as the crimper frame 124 is retracted upward generally away from the crimping zone 106, the crimped terminal 110 is released from the crimper jaws 170, 172 as the crimper frame 124 is retracted. When the crimper frame 124 is retracted, the abutment surfaces 162, 164 are no longer forced downward toward the outer surfaces 188 of the crimper jaws 170, 172, but rather are pulled upward with respect to the crimper jaws 170, 172. The crimper jaws 170, 172 are translated longitudinally at least partially out of the jaw mount chamber 160 during a return stroke portion of the crimping process to allow relative movement of the crimper jaws away from one another. The crimper jaws 170, 172 are moved slightly out of the jaw mount chamber 160, such as by a distance 222. When the crimper jaws 170, 172 are moved out of the jaw mount chamber 160, the crimper jaws 170, 172 as may be moved outward into the gap 198 (shown in FIG. 3B) toward the crimper frame 124. As the crimper jaws 170, 172 are moved outward, the inner surfaces 186 are spread apart from one another such that a gap 224, shown in FIG. 4C, is formed therebetween. By spreading the crimper jaws 170, 172 apart from one another, the vertical segments 214 of the lead-in sections 212 are similarly spread apart from one another to provide clearance for the terminal 110 to release from the crimp tooling 126.

The jaw mount 178 is also moved relative to the crimper frame 124 as the crimper frame 124 is moved upward to the released position. For example, the bottom 202 of the jaw mount 178 is moved towards and/or engages the shoulders 204. As the jaw mount 178 is moved downward relative to the crimper frame 124 into the space 200 (shown in FIG. 3B), a space 226 is defined between a top 228 of the jaw mount 178 and a top 230 of the jaw mount chamber 160. Optionally, the biasing element 206 may be provided between the tops 228 and 230. The biasing element 206 forces the jaw mount 178 towards the shoulders 204.

FIG. 5 illustrates a series of steps A-F of a crimping process using the crimp assembly 108 to crimp the terminal 110 to the wire 112, which has been removed for clarify. In the first step, step A, the terminal 110 is presented at the support surface 210 of the anvil 118. A base 240 of the terminal 110 rests upon the support surface 210 and wings 242 of the terminal 110 extend upward from the base 240. The anvil 118 is stationary, and the crimp tooling 126 is moved relative to the anvil 118 to crimp the terminal 110 to the wire 112. As the crimp tooling 126 is moved toward the seated position, the crimper jaws 170, 172 are forced into engagement with one another such that the inner surfaces 186 engage one another. The lead-in sections 212 of the crimper jaws 170, 172 guide the crimp tooling 126 into position relative to the terminal 110 and the anvil 118. The wings 242 may engage the lead-in sections 212 as the crimp tooling 126 is moved downward towards the seated position.

In the second step, step B, the terminal engagement surfaces 184 engage the wings 242 of the terminal 110 and start to form the crimp. Even in the pre-seated position of the crimp tooling 126 illustrated in step B, the anvil 118 is aligned with the vertical segments 214 of the crimper jaws 170, 172. Little or no clearance is provided between the anvil 118 and the crimper jaws 170, 172 to reduce or eliminate the possibility of flashing of the terminal 110 during the crimp process.

In the third step, step C, pressure from the crimp fooling 126 begins to form the terminal 110. For example, the wings 242 are forced downward and outward to flatten the base 240 and to define base corners 241.

In the fourth step, step D, continued pressure from the crimp tooling 126 continues to form the terminal 110. For example, the wings 242 are folded over by the fold-over sections 208.

In the fifth step, step E, the crimp tooling 126 is illustrated in the seated position. As the crimp tooling 126 is moved to the seated position, continued pressure from the crimp tooling 126 continues to form the terminal 110. For example, the wings 242 are forced downward towards the wire 112 (not shown). As illustrated, the formed terminal 110 has the same width as the distance 218 between the vertical segments 214. Removal of the terminal 110 from the crimp tooling 126 with the crimp tooling 126 in this position is difficult.

In the sixth step, step F, the crimp tooling 126 is illustrated as moving from the seated position towards the released position. As the crimp tooling 126 is moved towards the released position, the crimper jaws 170, 172 are spread apart from one another to form the gap 224 therebetween. Spreading apart of the crimper jaws 170, 172 provide clearance between the crimper jaws 170, 172 and the terminal 110. Such clearance allows for easy removal of the terminal 110 from the crimp tooling 126, even with the vertical segments 214. The vertical segments 214 provide for a good, high-quality crimp having little or no possibility for flashing, and the split jaw design of the crimp tooling 146 allows for easy removal of the terminal 110 from the crimp tooling 126.

FIG. 6 illustrates a series of steps A-E of the crimping process using the crimp assembly 108 to crimp the terminal 110 to the wire 112 (shown in FIG. 1), which has been removed for clarity. FIG. 6 illustrates the crimp tooling 126 deflecting during the crimping process. In the first step, step A, the terminal engagement surfaces 184 engage the wings 242 of the terminal 110 and start to form the crimp. Pressure from the crimp tooling 126 begins to form the terminal 110 by forcing the wings 242 downward and outward to flatten the base 240 and by folding over the wings 242.

In the second step, step B, the crimp tooling 126 is illustrated in a pre-seated position. As the crimp tooling 126 is moved toward the seated position, continued pressure from the crimp tooling 126 continues to form the terminal 110. For example, the wings 242 are forced downward towards the wire 112 (not shown). As the wings 242 are forced downward towards the wire 112, the wire 112 is likewise forced outward against sidewall portions 244 of the wings 242. The sidewall portions 244 are pressed against the terminal engagement surfaces 184 of the crimper jaws 170, 172. The force may be great enough to force the crimper jaws 170, 172 away from one another.

In the third step, step C, the crimp assembly 108 is illustrated immediately after the second step. A portion of the support member 122 is illustrated, namely the crimper deflection stop 138, as well as a portion of the crimper frame 124, namely the beam 166. A gap 250 is provided between the side 154 of the crimper frame 124 and the engagement surface 142 of the crimper deflection stop 138. The gap 250 provides clearance for the beam 166 to be moved outward during the crimping process. For example, as the wire 112 pushes the side wall portions 244 of the terminal 110 against the crimper jaw 170, the crimper jaw 170 is forced against the abutment surface 162 of the beam 166. The force may be great enough to splay the crimper jaw 170 and the corresponding beam 166 outward towards the crimper deflection stop 138.

In the fourth step, step D, the crimper frame 124 is forced outward against the crimper deflection stop 138 along a deflection axis 251. The side 154 engages the engagement surface 142. The crimper deflection stop 138 is rigid enough to resist further outward movement of the beam 166. The terminal 110 similarly forces the other crimper jaw 172 outward. The crimper jaws 170, 172 are splayed outward such that the inner surfaces 186 are separated by a distance 252 to form the gap 224. The distance 252 may be equal to the width of the gap 250 plus any similar gap that exists between the other beam 168 and crimper deflection stop 140. As the crimper jaws 170, 172 are spread apart, the fold-over sections 208 force the wings 242 of the terminal 110 to similarly spread apart. When the wings 242 are pulled apart, the stress direction of the wings 242 is changed. For example, when the terminal 110 is released, the wings 242 may tend to pull inward toward one another and toward the wire 112. The spring back force of the wings 242 is directed in the inward direction towards the wire 112.

In the fifth step, step E, the crimp tooling 126 is illustrated as moving from the seated position towards the released position. As the crimp tooling 126 is moved towards the released position, the crimper jaws 170, 172 are spread apart from one another. Spreading apart of the crimper jaws 170, 172 provides clearance between the crimper jaws 170, 172 and the terminal 110 to allow for removal of the terminal 110 from the crimp tooling 126. The terminal 110 is illustrated with the wings 242 in a wing lock position in which the wings 242 engage one another. Because the wings 242 were spread apart and pulled outward during the crimp forming process, the spring back force of the sidewall portions 244 is in an inward direction, shown by the arrows I. As such, the wings 242 tend to close in on each other and on the wire 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A crimp assembly for a terminal crimping machine that crimps a terminal to a wire, the crimp assembly comprising:

a crimper frame having opposed ends and a longitudinal axis extending between the opposed ends, the crimper frame having a jaw mount chamber therein, the jaw mount chamber being open at one of the ends of the crimper frame, the crimper frame having abutment surfaces defining portions of the jaw mount chamber;

a jaw mount held by the crimper frame in the jaw mount chamber, the jaw mount having sockets; and crimp tooling held within the jaw mount, the crimp tooling comprising a pair of crimper jaws received in corresponding sockets of the jaw mount, the crimper jaws being pivotably coupled to the jaw mount, in the sockets, and movable with respect to one another, the crimper jaws having terminal engagement surfaces configured to engage the terminal to form a wire crimp during a crimping process, the crimper jaws having outer surfaces, wherein the abutment surfaces of the crimper frame engage the outer surfaces of the crimper jaws during the crimp process to move the crimp tooling in a first direction generally along the longitudinal axis and in a second direction transverse to the first direction.

2. The crimp assembly of claim 1, wherein the crimp tooling constitutes split-jaw crimp tooling, the terminal engagement surfaces of the jaws have fold-over sections configured to fold wings of the terminal inward towards the wire during the crimping process.

3. The crimp assembly of claim 1, wherein the crimper jaws are mirrored halves of the crimp tooling, the crimper jaws are coplanar with the crimper frame and with one another.

4. The crimp assembly of claim 1, wherein the crimper jaws are configured to release away from one another after the wire crimp is formed, to release the terminal from the terminal engagement surfaces.

5. The crimp assembly of claim 1, wherein the crimper jaws are translated longitudinally at least partially out of the jaw mount chamber during a return stroke portion of the crimping process to allow relative movement of the crimper jaws away from one another.

6. The crimp assembly of claim 1, wherein the crimper jaws include mating surfaces, the mating surfaces being forced into engagement with one another during the crimping process.

7. The crimp assembly of claim 1, further comprising a support member having opposed crimper deflection stops, the crimper frame being held by the support member, the crimper frame having opposed sides that face corresponding crimper deflection stops, the crimper frame being movable along a deflection axis extending between the crimper deflection stops, the crimper jaws being splayed apart by the terminal during the crimping process such that the outer surfaces bear against the abutment surfaces and force the crimper frame to deflect outward toward the crimper deflection stops.

8. The crimp assembly of claim 7, wherein the crimper deflection stops define deflection limits for the crimper frame.

9. The crimp assembly of claim 7, wherein the splaying apart of the crimper jaws allows the terminal to spread out during the crimping process such that the crimped terminal has an inward spring back force.

10. The crimp assembly of claim 7, wherein the splaying apart of the crimper jaws changes the stress direction of the terminal such that wings of the crimped terminal pull inward toward the wire.

11. The crimp assembly of claim 7, wherein the crimper deflection stops are spaced apart by a distance that is wider than the crimper frame such that a gap is created between at least one of the sides of the crimper frame and at least one of the crimper deflection stops, the distance accommodating deflection of the crimper frame during the crimping process.

12. The crimp assembly of claim 7, wherein the jaw mount chamber is aligned between the crimper deflection stops.

13. The crimp assembly of claim 1, wherein the abutment surfaces are angled non-parallel to the longitudinal axis.

14. A terminal crimping machine that crimps a terminal to a wire, the terminal crimping machine comprising:

a crimper frame having a jaw mount chamber open at an end of the crimper frame, the crimper frame having abutment surfaces defining portions of the jaw mount chamber;

a jaw mount held by the crimper frame in the law mount chamber, the jaw mount having sockets; and split-jaw crimp tooling having two crimper jaws separate from one another and held within corresponding sockets in the jaw mount chamber, the crimper jaws being pivotably coupled to the jaw mount, in the sockets, and movable with respect to one another, each crimper jaw having terminal engagement surfaces configured to engage the terminal to form a wire crimp during a crimping process, the terminal engagement surfaces having fold-over sections configured to fold wings of the terminal inward towards the wire during the crimping process, the crimper jaws being movable with respect to one another during the crimping process, wherein the fold-over sections are separated from one another after the terminal is crimped, to release the terminal from the crimp tooling.

15. The terminal crimping machine of claim 14, further comprising an anvil, the crimper frame driving the crimp tooling along a driving axis generally towards and away from the anvil during the crimping process, the crimper jaws being movable away from the anvil in a direction transverse to the driving axis to release the terminal from the terminal engagement surfaces.

16. The terminal crimping machine of claim 14, wherein the crimper jaws are translated longitudinally at least partially out of the jaw mount chamber during a return stroke portion of the crimping process to allow relative movement of the crimper jaws away from one another.

17. The crimp assembly of claim 14, further comprising:

a support member having opposed crimper deflection stops;

the crimper frame held by the support member, the crimper frame having opposed sides that face corresponding crimper deflection stops; and each crimper jaw having an outer surface engaged by a corresponding abutment surface during the crimping process, the crimper jaws being splayed apart by the terminal during the crimping process such that the outer surfaces bear against the abutment surfaces and force the crimper frame to deflect outward toward the crimper deflection stops.

* * * * *